US010938170B1

(12) United States Patent
Chen

(10) Patent No.: US 10,938,170 B1
(45) Date of Patent: Mar. 2, 2021

(54) QUICK ELECTRICAL POWER CONNECTOR SYSTEM

(71) Applicant: Sikai Chen, Delran, NJ (US)

(72) Inventor: Sikai Chen, Delran, NJ (US)

( * ) Notice: Subject to any disclaimer, the term of this patent is extended or adjusted under 35 U.S.C. 154(b) by 0 days.

(21) Appl. No.: 16/827,890

(22) Filed: Mar. 24, 2020

Related U.S. Application Data

(60) Provisional application No. 62/964,194, filed on Jan. 22, 2020.

(51) Int. Cl.

| | |
|---|---|
| ***H01R 25/00*** | (2006.01) |
| *H01R 31/02* | (2006.01) |
| *H01R 13/52* | (2006.01) |
| *H01R 24/84* | (2011.01) |
| *H01R 9/03* | (2006.01) |
| *H01R 24/28* | (2011.01) |

(52) U.S. Cl.
CPC ..... *H01R 25/003* (2013.01); *H01R 9/03* (2013.01); *H01R 13/5219* (2013.01); *H01R 24/28* (2013.01); *H01R 24/84* (2013.01); *H01R 31/02* (2013.01)

(58) Field of Classification Search
CPC ..... H01R 9/03; H01R 24/28; H01R 24/84; H01R 25/003; H01R 31/02; H01R 13/5219
See application file for complete search history.

(56) References Cited

U.S. PATENT DOCUMENTS

| | | | | |
|---|---|---|---|---|
| 1,927,001 A * | 9/1933 | Lewis | A45D 4/06 | 219/222 |
| 3,745,515 A * | 7/1973 | Michaels | H01R 27/02 | 439/651 |
| 4,571,018 A * | 2/1986 | Annoot | H01R 13/5205 | 439/275 |
| 5,855,494 A * | 1/1999 | Blaszczyk | H01R 31/02 | 361/735 |
| 6,383,003 B1 * | 5/2002 | Corona | H01R 13/5219 | 439/106 |
| 6,422,884 B1 * | 7/2002 | Babasick | H01R 13/5812 | 439/222 |

(Continued)

FOREIGN PATENT DOCUMENTS

WO WO-2019121784 A1 * 6/2019 ..... H01R 31/02

*Primary Examiner* — Tho D Ta
(74) *Attorney, Agent, or Firm* — Stuart M. Goldstein

(57) ABSTRACT

A quick electrical power connector system has a female connection member, a forward section with electrical plug openings extending through the forward section and a rear section through which electrical wiring extends into and connects with electrical contacts within the plug openings. A male connection member has a forward section, a cavity, and electric prongs located within the cavity. The male connection member also has a second section located immediately adjacent to the forward section, the second section having side walls through which electrical wiring completely extends and connects with electrical contacts connected to the electric prongs. The male connection member is configured to be connected to the female connection member to provide supplemental electrical current to electrical circuitry. A second embodiment provides for a male connection member having two cavities, each with two electrical prongs for connection with two female connection members in electrical circuitry.

1 Claim, 11 Drawing Sheets

(56) References Cited

U.S. PATENT DOCUMENTS

| | | | | |
|---|---|---|---|---|
| 7,017,598 | B2 * | 3/2006 | Nipke | A45B 3/00 135/16 |
| 7,063,574 | B2 * | 6/2006 | Mazzullo | H01R 13/113 439/677 |
| 2006/0194467 | A1 * | 8/2006 | Beasley | H01R 13/6675 439/339 |
| 2011/0005907 | A1 * | 1/2011 | Serak | H01R 31/02 200/51.05 |
| 2011/0194817 | A1 * | 8/2011 | Hopmann | H01R 13/523 385/55 |
| 2015/0340806 | A1 * | 11/2015 | Ilkhanov | H01R 13/5219 439/278 |
| 2020/0321740 | A1 * | 10/2020 | Gassner | H01R 31/02 |

* cited by examiner

QUICK ELECTRICAL POWER CONNECTOR SYSTEM

RELATED APPLICATION

This application claims the benefit of provisional application Ser. No. 62/964,194, filed on Jan. 22, 2020.

FIELD OF THE INVENTION

The present invention relates to a simple and effective means for providing supplemental electrical power to the electrical circuit, without the need to cut existing electrical conductive wiring.

BACKGROUND OF THE INVENTION

Additional electrical power is often required in electric circuits, for instance in circuitry utilized in LED modules of neon lamps. Current methods of cutting electrical wiring and splicing in separate wiring from electric power sources are time consuming and inefficient, resulting in interruptions of service. Significantly, these wire cutting methods often result in faulty connections which will disrupt the electric circuit.

SUMMARY OF THE INVENTION

It is thus the object of the present invention to provide a quick electrical power connector which addresses the disadvantages of traditional electrical power connection methods.

This and other objects are accomplished by the present invention, an electrical power connector system which is configured to be installed simply, easily, and quickly into an existing electrical circuit to provide a supplemental source of electrical power.

The system of the present invention comprises a female connection member, a forward section with electrical plug openings extending through the forward section, and a rear section through which electrical wiring extends into and connects with electrical contacts within the plug openings. A male connection member comprises a forward section having a rear wall, a cavity, and electric prongs located within the cavity and extending outwardly from the rear wall. The male connection member also has a second section located immediately adjacent to the forward section of the male connection member, the second section having side walls through which electrical wiring completely extends and connects with electrical contacts connected to the electric prongs. The male connection member is thus configured to be connected to the female connection member to provide supplemental electrical current to electrical circuitry. A second embodiment of the invention provides for a male connection member having two cavities, each with two electrical prongs for connection with two female connection members in electrical circuitry.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
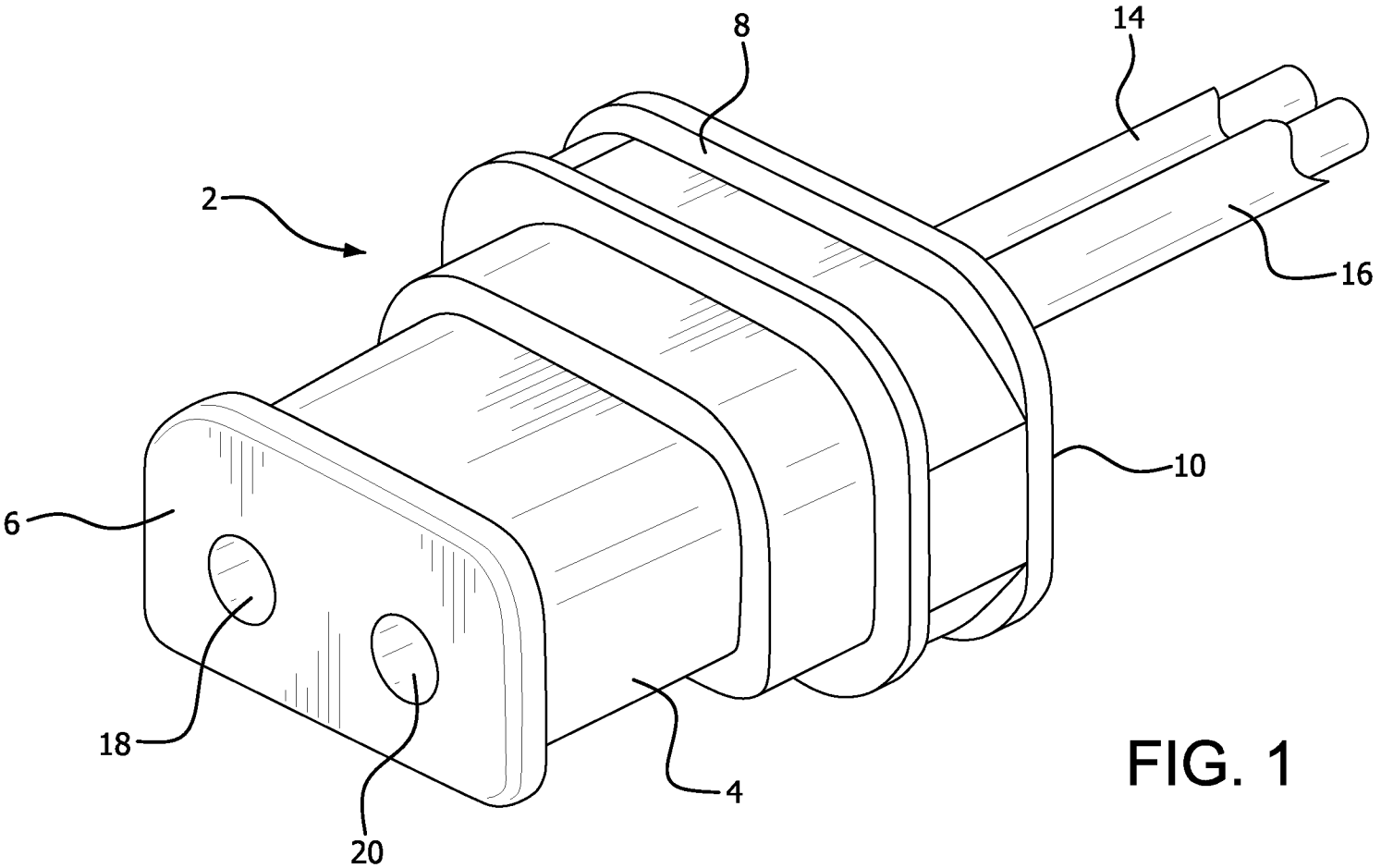
FIG. 1 is a perspective view of the female connection member of the quick electrical power connector system of the present invention.
Figure 2:
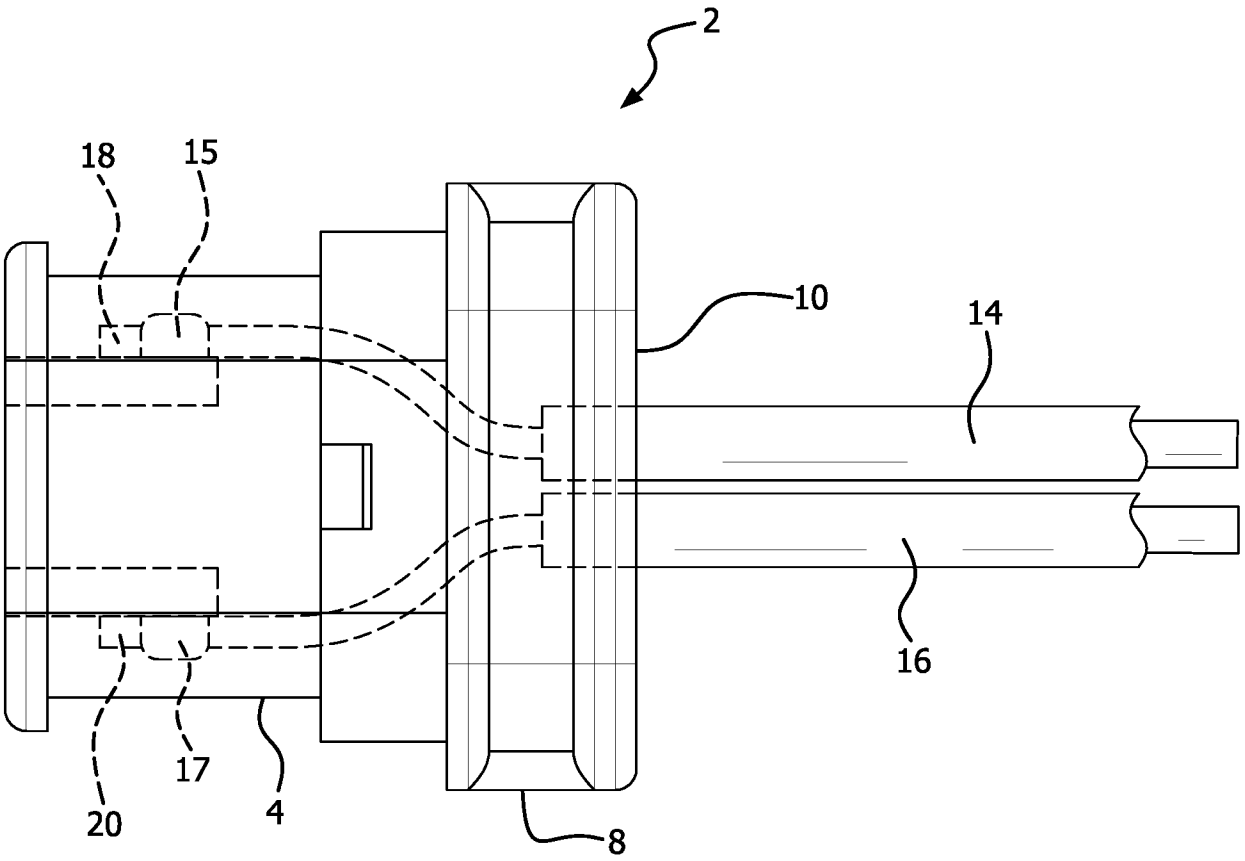
FIG. 2 is a top, partially ghosted view of the female connection member of the quick electrical power connector system of the present invention.
Figure 3:
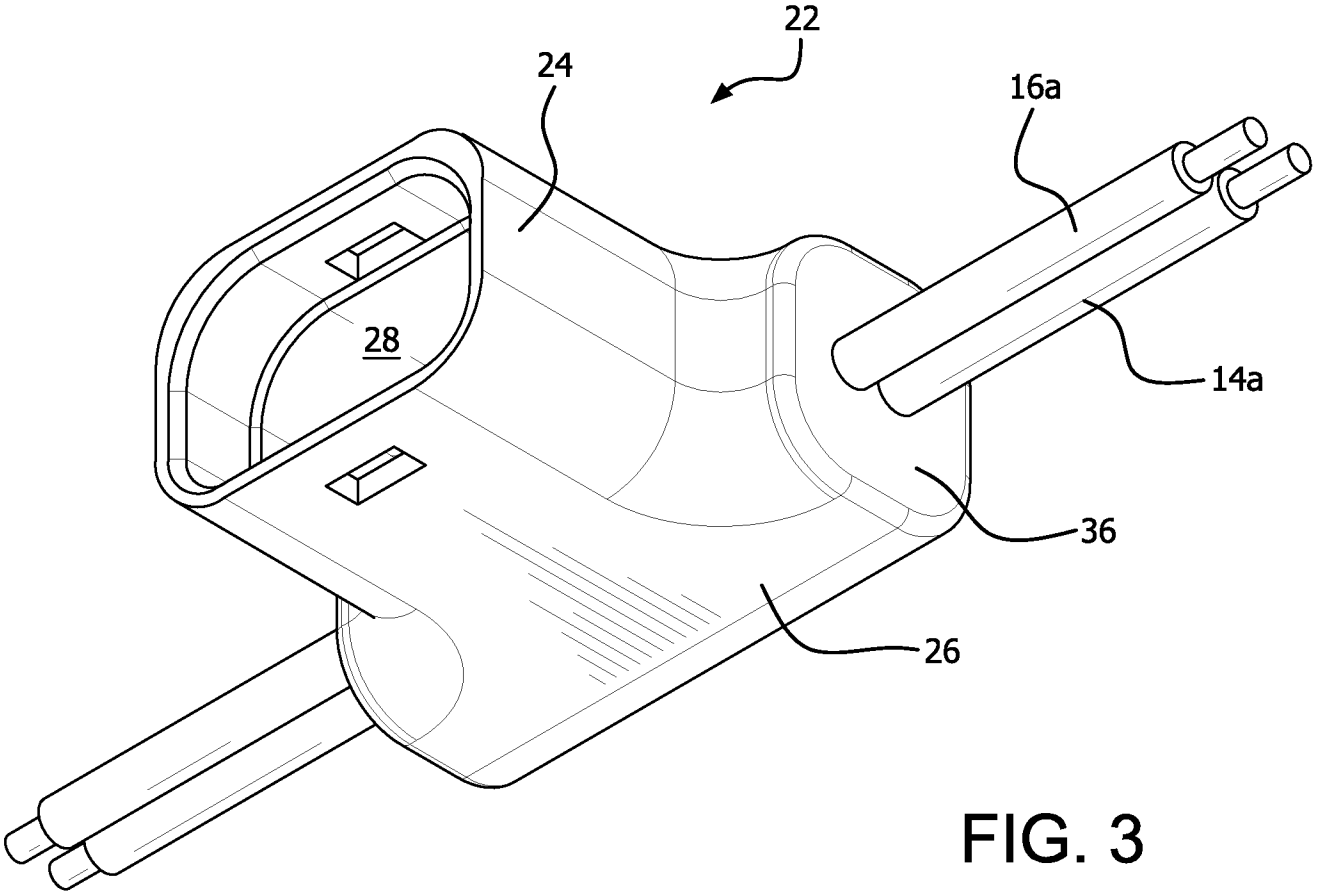
FIG. 3 is a perspective view of the male connection member of the quick electrical power connector system of the present invention.
Figure 4:
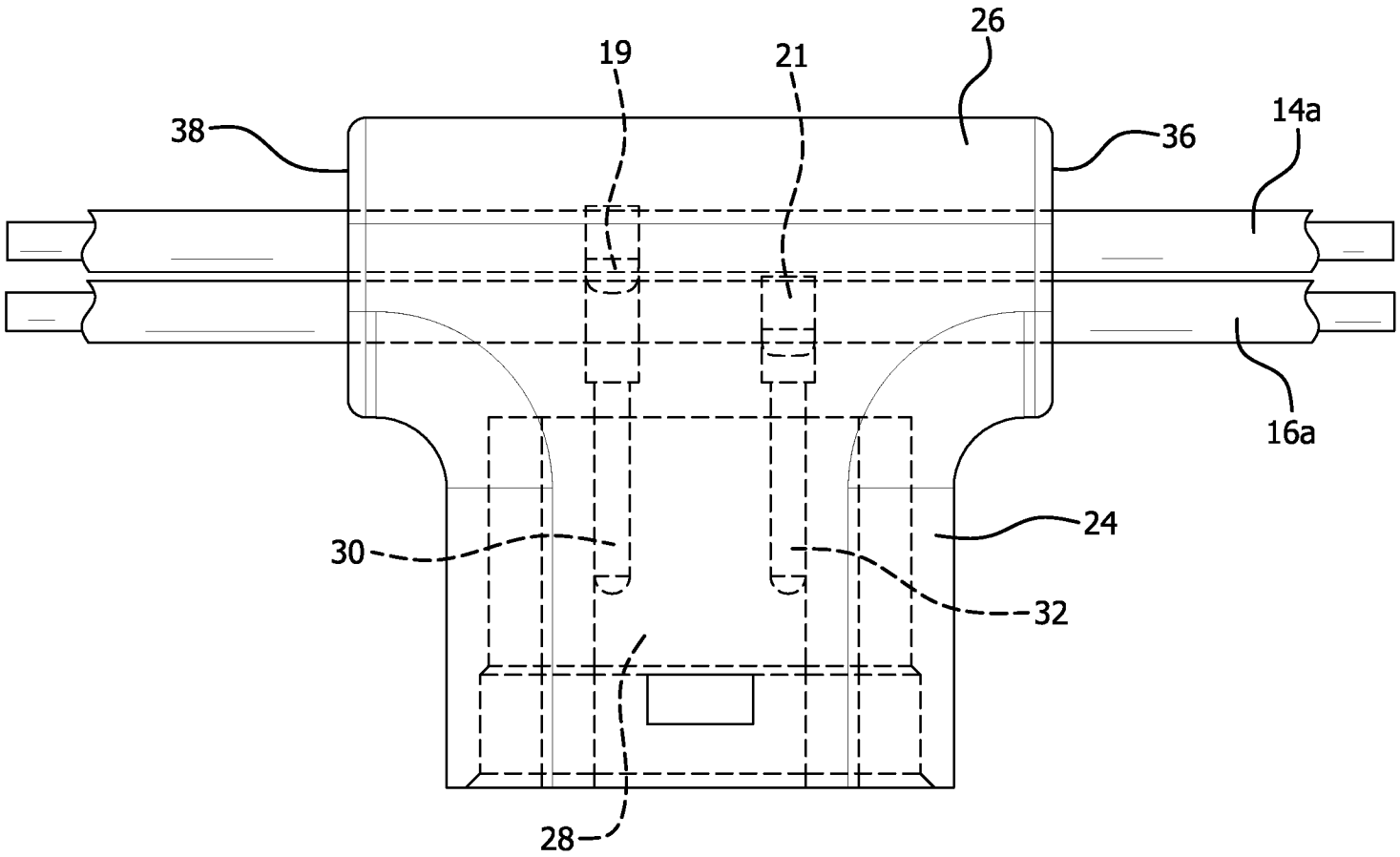
FIG. 4 is a top, partially ghosted view of the male connection member of the quick electrical power connector system of the present invention.
Figure 5:
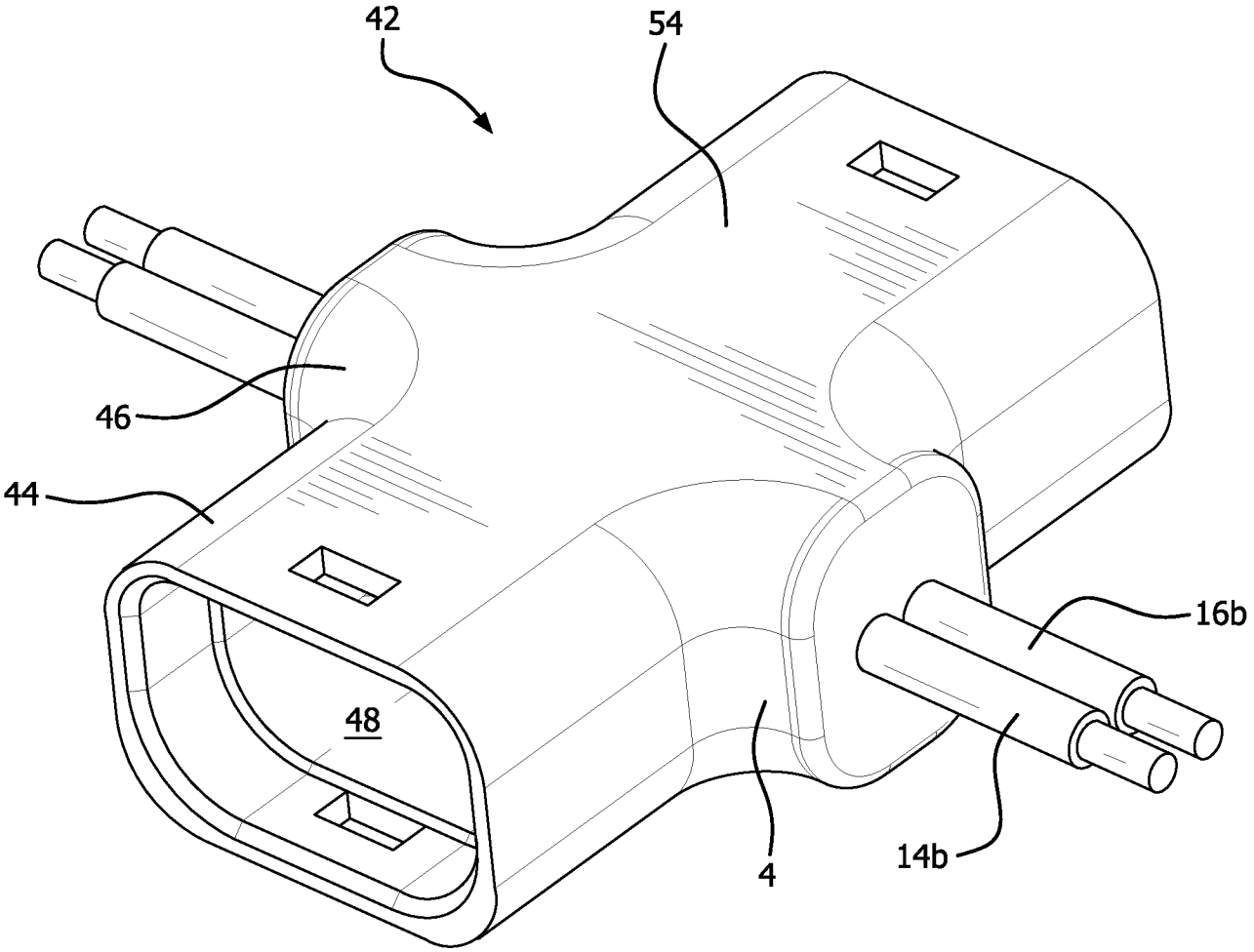
FIG. 5 is a perspective view of a second embodiment of the male connection member of the quick electrical power connector system of the present invention.
Figure 6:
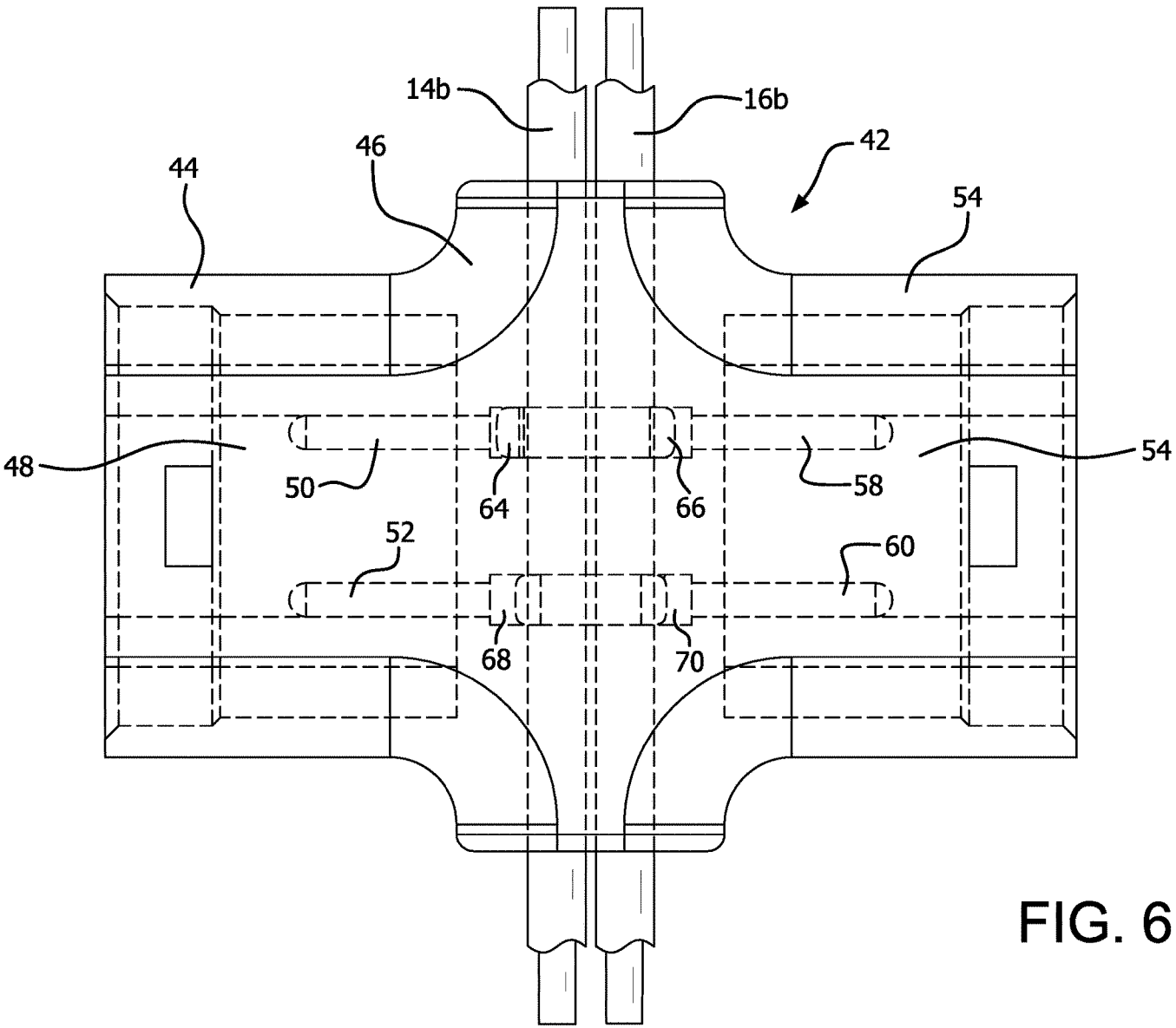
FIG. 6 is a top, partially ghosted view of the second embodiment of the male connection member of the quick electrical power connector system of the present invention.

The quick electrical power connector system of the present invention comprises female connection member 2 and male connection member 22. Female connection member 2 comprises forward section 4 with front wall 6 and rear section 8 with backwall 10. Rear section 8 accepts electrical wires 14 and 16 extending through backwall 10. Wires 14 and 16 then connect with electrical contacts 15 and 17 within electrical plug openings 18 and 20 in front section 4. Wires 14 and 16 are part of existing electrical modular lighting circuitry 100 which ultimately are connected to power source 102.

Male connection member 22 comprises forward section 24 and rear section 26. Forward section 24 has cavity 28. Electrical prongs 30 and 32 are located within and extend outwardly into cavity 28. Second section 26 of male section 22 comprises side walls 36 and 38. Second section 26, located immediately adjacent to forward section 24, accepts wires **14*a* and 16*a* which extend completely through the second section, via side walls 36 and 38. Once again, wires 14*a* and 16*a* are part of existing electrical modular lighting circuitry 100. Prongs 30 and 32 are connected to wires 14*a* and 16*a* by contacts 19 and 21**.

A second embodiment of the male connection member of the present invention comprises male connection member 42 which is similar to male member 22 in that it has electrical wires **14*b* and 16*b* extending completely through a second section 46 adjacent to forward section 44 of the connection member, with cavity 48 having electrical plugs 50 and 52 extending outwardly from rear wall 54. However, male member 42 also has third section 54 adjacent to second section 46. Third section 54 has cavity 56 and outwardly extending electrical prongs 58 and 60 identical to that which is found in forward section 44 of male connection member 42. As such, male connection member 42 is substantially symmetrical, having electrical wires 14***b* and 16*b* extending through the middle of the connector member. Electrical prongs 50, 52, 58 and 60 are connected to wires 14*b* and 16*b* by contacts 64, 66, 68 and 70. These electric prongs have the capability to accept female connection members 2 at both ends of male connection member 42, thus increasing the versatility within electric circuitry 100.

Figure 7:
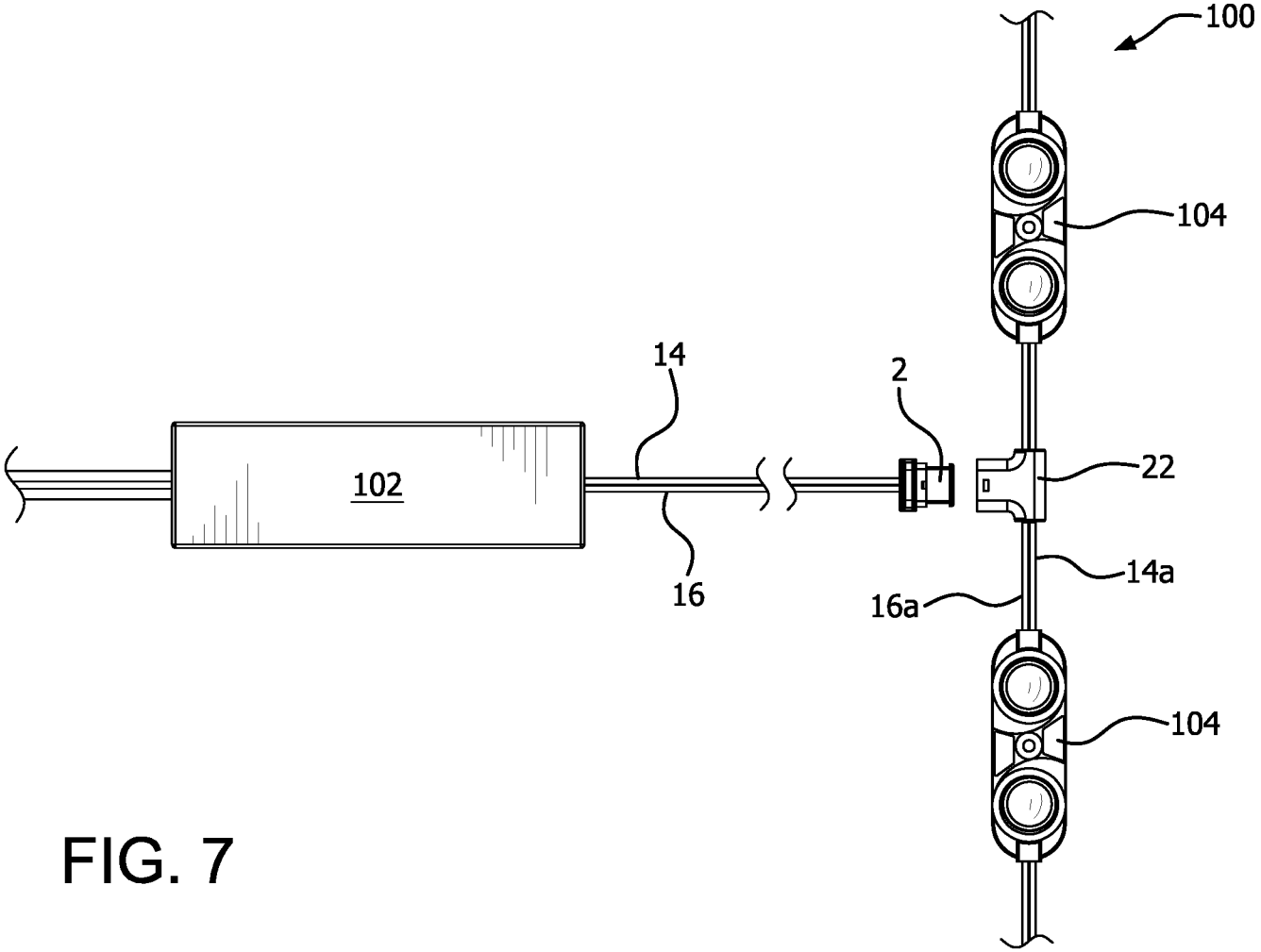
FIG. 7 is a top view illustrating the manner of connection between the female connection member and the male connection member of the present invention in electrical circuitry.
Figure 8:
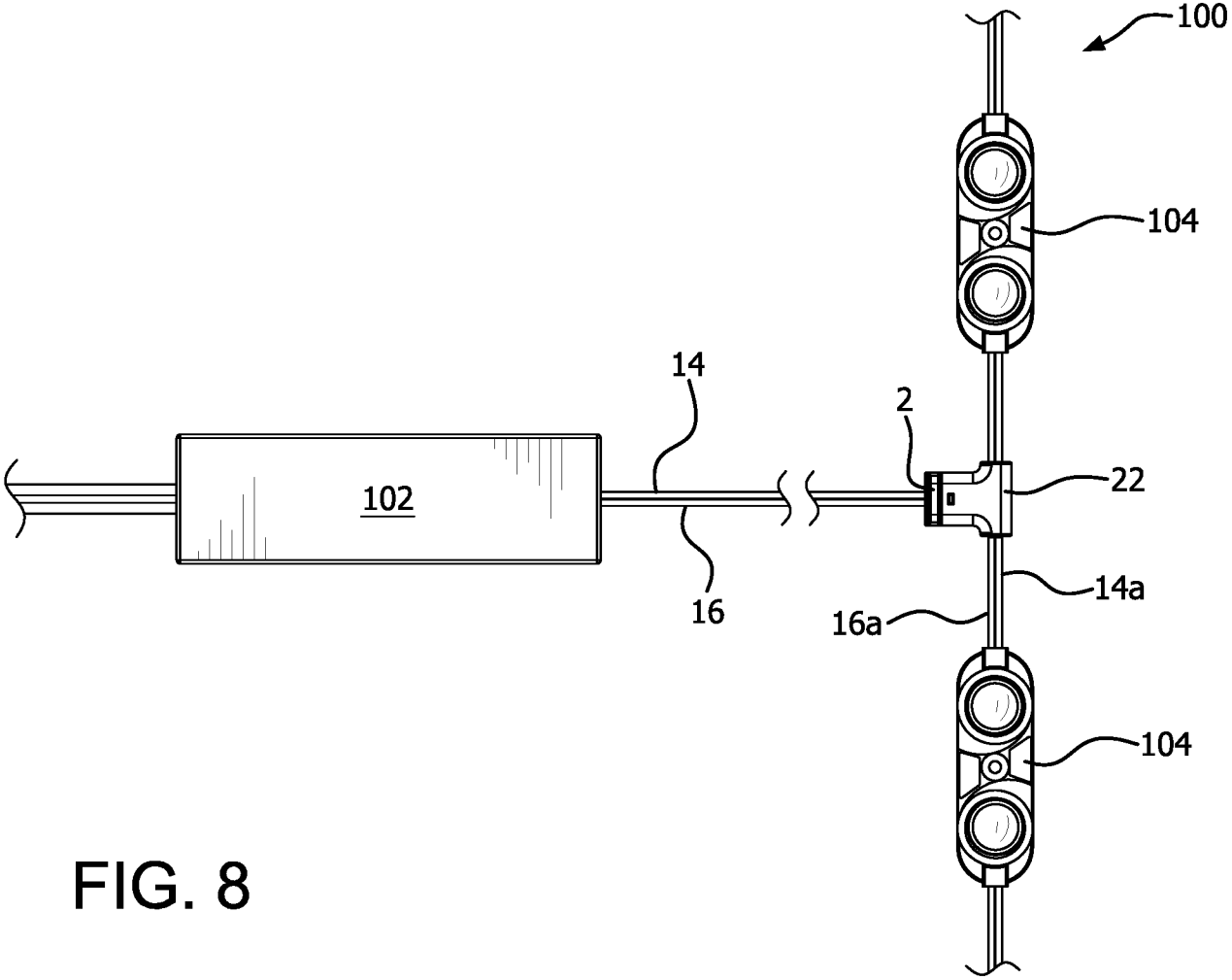
FIG. 8 is a top view illustrating the actual connection of the female connection member and the male connection member of the present invention in electrical circuitry.

In use, female connection member 2 can be connected to electrical power source 102 via wires 14 and 16 of electrical circuitry 100, which includes LED lighting modules 104. Electric plug openings 18 and 20 of female connection member 2 are inserted over prongs 30 and 32 in cavity 28 of male connection member 22, connected to electrical circuitry 100 via wires 14, 16, and 14*a* and 16*a* (See FIGS. 7 and 8), thus providing supplemental electrical power to the circuitry.

Figure 9:
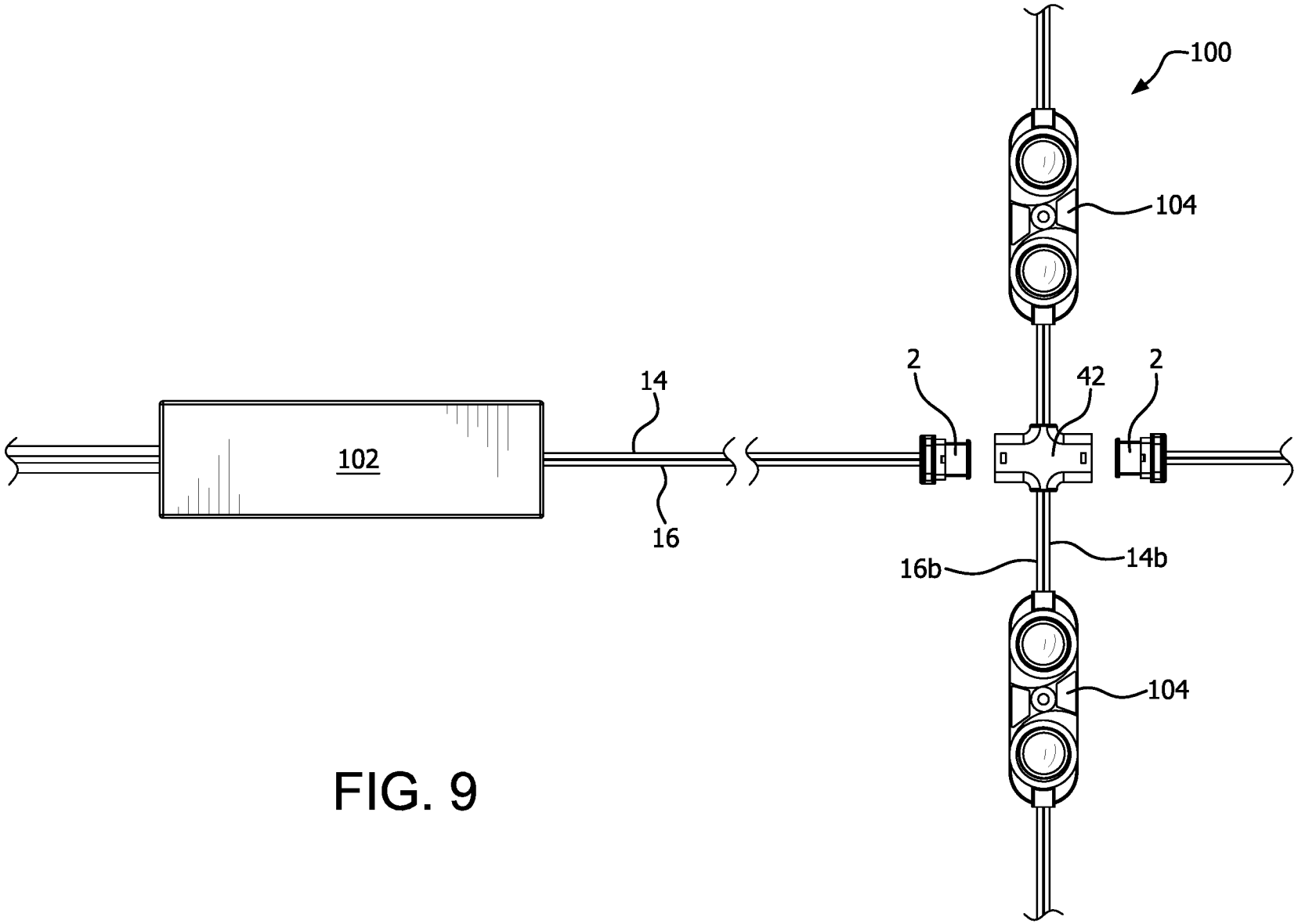
FIG. 9 is a top view illustrating the manner of connection between female connection members and the second embodiment of the male connection member of the present invention in electrical circuitry.
Figure 10:
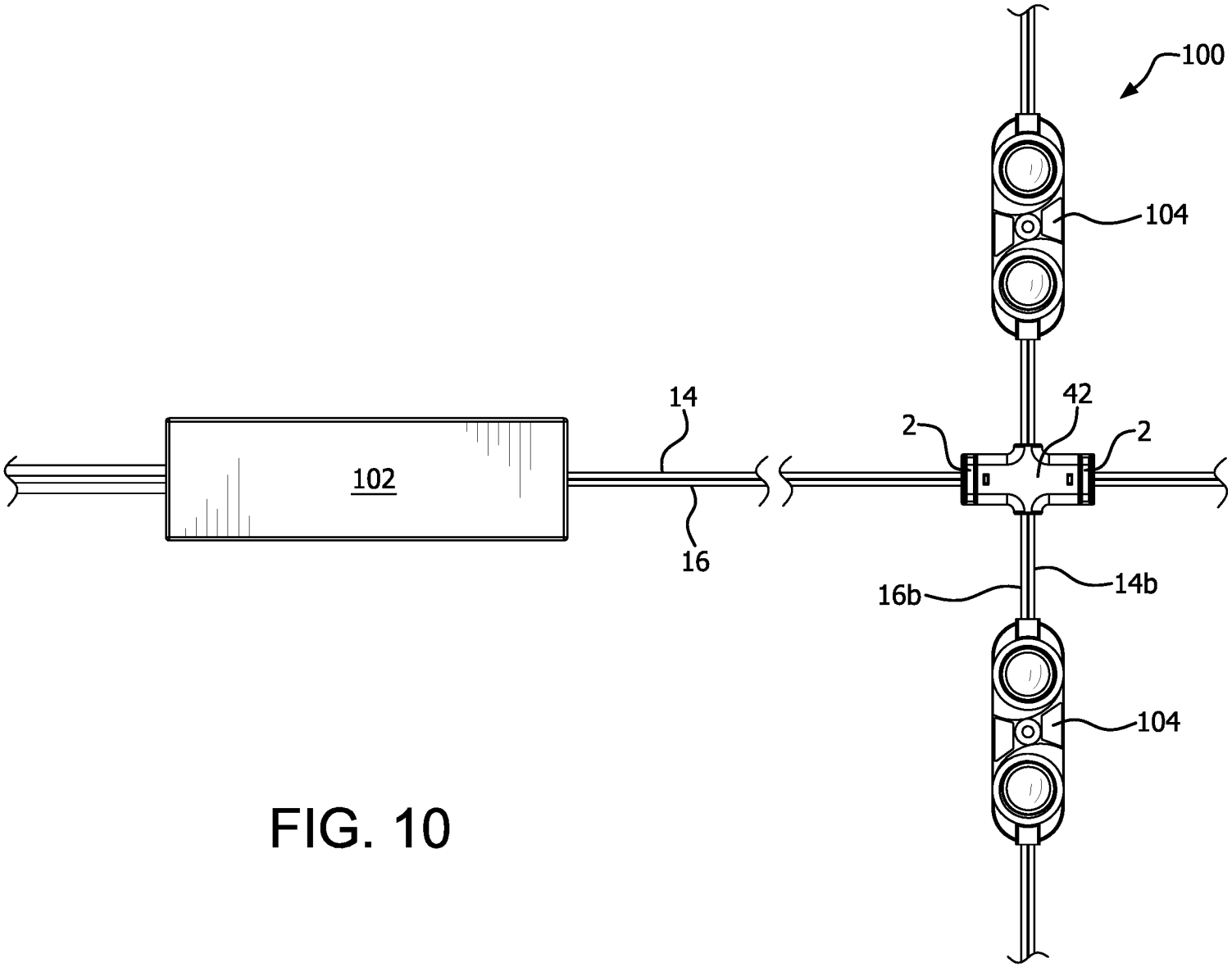
FIG. 10 is a top view illustrating the actual connection of female connection members and the second embodiment of the male connection member of the present invention in electrical circuitry.

In like manner, female connection member 2 can be connected to electrical power source 102 via wires 14 and 16, by means of male connection member 42. Electric plug openings 18 and 20 of female connection member 2 are inserted over prongs 50, 52, 58 and 60 in cavities 48 and 54 of male connection member 42, connected to electrical circuitry 100 via wires 14, 16, 14*b* and 16*b* (See FIGS. 9 and 10), thus again providing supplemental electrical power to the electrical circuitry.

Figure 11:
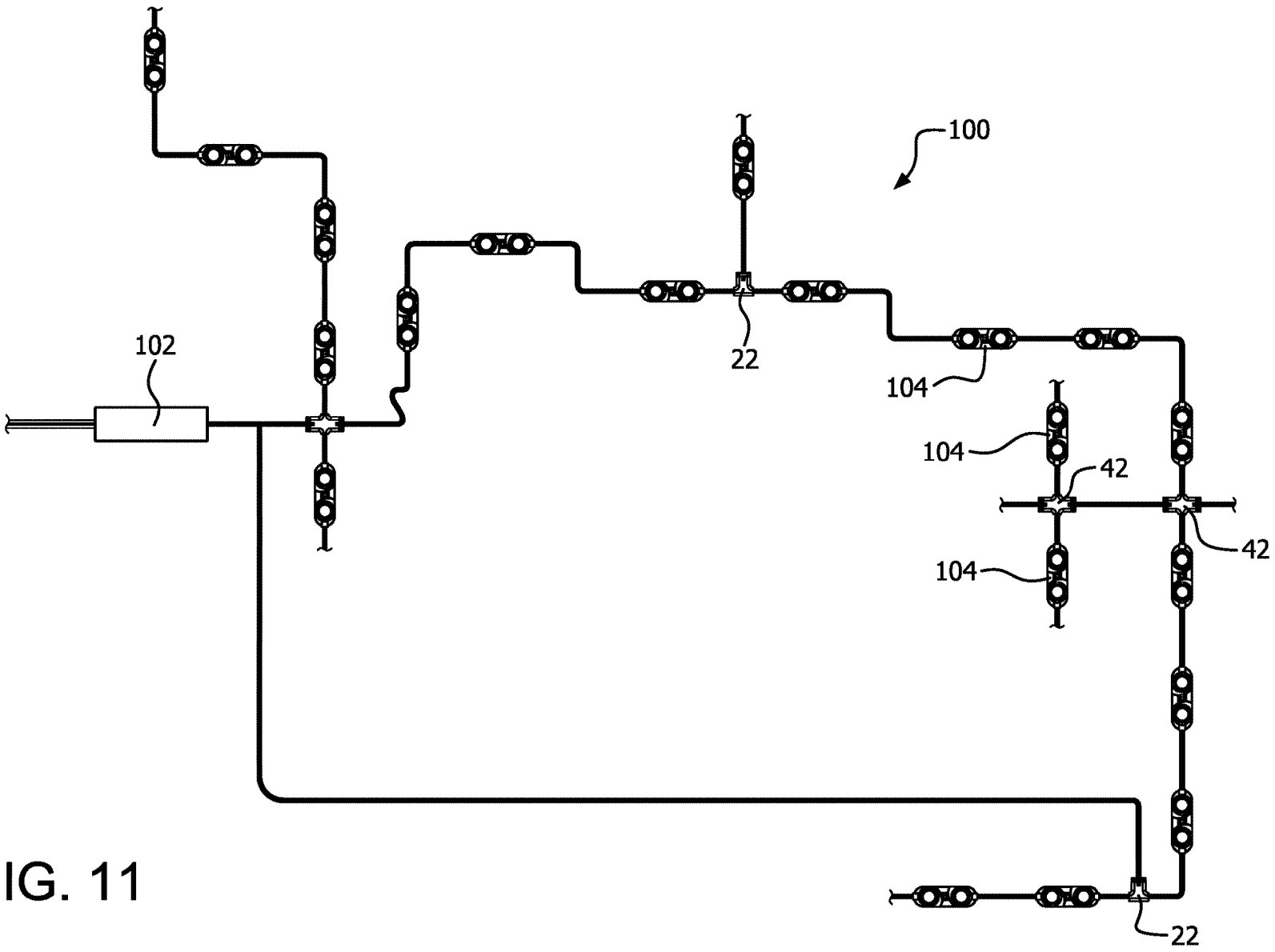
FIG. 11 is a top view showing an example of electric LED module circuitry utilizing the quick electrical power connector system of the present invention.

By the present invention, electrical circuitry, for example as shown in the LED modular lighting circuitry in FIG. 11, can be constructed in a variety of circuit configurations powered by a single supplemental electrical power source 102, or multiple electrical power sources if desired. The versatility afforded by the electrical power connector system of the present invention to provide quick connection electrical power has applications, not only in LED lighting modular of neon lamps, but in a wide variety of electrical circuitry.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A quick electrical power connection system for providing supplemental electrical current to electrical circuitry, said system comprising:

an independent female connection member configured to be separable from a male connection member, said female connection member having a forward section with electrical plug openings extending through the forward section, and a rear section having electrical wiring extending into the rear section and connecting with electrical contacts within the plug openings; and an independent male connection member configured to be separable from the female connection member, said male connection member comprising a forward section having a rear wall, a cavity, and electric prongs located within the cavity and extending forward and outwardly from the rear wall, a second section extending the width of the male connection member and being located immediately adjacent to and rearward of the forward section, a third section immediately adjacent to and rearward of the second section, said third section having a rear wall, a cavity and electric prongs located within said cavity, the second section being located between and extending at least the width of the forward and third sections and having electrical wiring which extends completely and uninterrupted through only the second section, between the forward and third sections, the electric wiring being connected to electrical contacts attached to the electric prongs located in the forward section and to the electric prongs in the third section, all the electric contacts being located within the second section;

wherein the male connection member is configured to be electrically connected to first and second female connection members, the female connection members each extending from opposite sides of the male connection member, the first female connection member being connected to the forward section of the male connection member solely by the insertion of the electric prongs of the forward section within the plug openings of the first female connection member, and the second female connection member being connected to the third section of the male connection member solely by the insertion of the electric prongs of the third section within plug openings of the second female connection member, said female connection members being completely detachable and separable from the male connection member solely by the removal of the electric prongs from the plug openings.

* * * * *